US008950326B1

(12) United States Patent
Van Denend et al.

(10) Patent No.: US 8,950,326 B1
(45) Date of Patent: Feb. 10, 2015

(54) METHOD AND APPARATUS FOR LASER ABLATING AN IMAGE ON A MOUNTED BLANK PRINTING PLATE

(75) Inventors: Mark E. Van Denend, Lackawaxen, PA (US); Arthur van der Weijden, Tilburg (NL)

(73) Assignee: Laser Dot Holding B.V., Tilburg (NL)

( * ) Notice: Subject to any disclaimer, the term of this patent is extended or adjusted under 35 U.S.C. 154(b) by 59 days.

(21) Appl. No.: 13/450,865

(22) Filed: Apr. 19, 2012

(51) Int. Cl.
*B41C 1/05* (2006.01)

(52) U.S. Cl.
USPC ..... 101/401.1; 430/306; 250/559.36

(58) Field of Classification Search
CPC ..... B41C 1/05; B41C 1/1075
USPC ..... 101/467, 395, 401.1, 487; 430/300, 430/306; 250/559.36
See application file for complete search history.

(56) References Cited

U.S. PATENT DOCUMENTS

| | | | | |
|---|---|---|---|---|
| 3,696,745 | A | 10/1972 | Morton | |
| 4,332,873 | A | 6/1982 | Hughes et al. | |
| 4,881,086 | A | 11/1989 | Misawa | |
| 5,252,838 | A | 10/1993 | Timblin | |
| 5,462,836 | A | 10/1995 | Hornschuh | |
| 5,488,781 | A | 2/1996 | Van Der Horst | |
| 5,535,672 | A | 7/1996 | Kuwahara | |
| 5,826,512 | A | 10/1998 | Niegawa et al. | |
| 5,992,325 | A | 11/1999 | Schumann et al. | |
| 6,016,752 | A | 1/2000 | Harari | |
| 6,109,745 | A * | 8/2000 | Wen | 347/101 |
| 6,117,615 | A | 9/2000 | Riechert et al. | |
| 6,247,404 | B1 | 6/2001 | Okamura | |
| 6,321,651 | B1 | 11/2001 | Tice et al. | |
| 6,510,793 | B1 | 1/2003 | Kerr et al. | |
| 6,681,699 | B2 | 1/2004 | Annoura | |
| 6,815,702 | B2 | 11/2004 | Kiermeier et al. | |
| 6,915,743 | B2 * | 7/2005 | Blohdorn et al. | 101/486 |
| 6,948,432 | B2 | 9/2005 | Dewitte | |
| 7,032,512 | B2 | 4/2006 | Salvestro | |
| 7,033,450 | B2 | 4/2006 | Salvestro | |
| 7,057,196 | B2 | 6/2006 | Fischer et al. | |
| 7,063,018 | B2 | 6/2006 | Smythies et al. | |
| 7,126,146 | B2 | 10/2006 | Fischer et al. | |
| 7,146,911 | B2 | 12/2006 | Omoto et al. | |
| 7,171,901 | B2 | 2/2007 | Salvestro | |
| 7,225,737 | B2 | 6/2007 | Gelbart et al. | |
| 7,256,810 | B2 | 8/2007 | Gottling et al. | |
| 7,284,484 | B2 | 10/2007 | Van Denend | |
| 7,398,732 | B2 | 7/2008 | Hebert et al. | |
| 7,419,765 | B2 | 9/2008 | Teltschik et al. | |
| 7,456,379 | B2 | 11/2008 | Neufeld et al. | |
| 7,819,060 | B2 | 10/2010 | Taylor et al. | |
| 7,854,199 | B2 | 12/2010 | Cummings et al. | |

(Continued)

*Primary Examiner* — Blake A Tankersley
(74) *Attorney, Agent, or Firm* — Richard M. Goldberg

(57) ABSTRACT

A method for laser ablating an image on a blank printing plate, includes providing a peripheral tolerance region at the edges of a printing plate, mounting the printing plate on a roller, detecting positions of at least one edge of the printing plate, determining positions of all edges of the printing plate in accordance with the detection, determining an image area within boundaries of the printing plate, laser ablating an image on the printing, within the image area, laser ablating all areas outside of the image area on the printing plate to provide a relief area at which no printing, based on the determined positions of all edges of the printing plate, and controlling the laser to prevent any laser ablation outside of boundaries of the edges of the printing plate, based on the determined positions of all edges of the printing plate, within the provided peripheral tolerance region.

14 Claims, 8 Drawing Sheets

(56) References Cited

U.S. PATENT DOCUMENTS

| | | | | |
|---|---|---|---|---|
| 2007/0248907 | A1* | 10/2007 | Van Denend et al. | 430/269 |
| 2007/0272103 | A1 | 11/2007 | Caliari | |
| 2008/0245981 | A1 | 10/2008 | Hebert | |
| 2009/0226841 | A1 | 9/2009 | Kamitani et al. | |
| 2010/0101439 | A1 | 4/2010 | Funk et al. | |
| 2010/0101440 | A1 | 4/2010 | Funk et al. | |
| 2010/0132574 | A1 | 6/2010 | Hawes et al. | |
| 2010/0133451 | A1 | 6/2010 | Hawes et al. | |
| 2011/0005418 | A1 | 1/2011 | Cummings et al. | |

* cited by examiner

METHOD AND APPARATUS FOR LASER ABLATING AN IMAGE ON A MOUNTED BLANK PRINTING PLATE

BACKGROUND OF THE INVENTION

The present invention relates generally to blank printing plates mounted on cylindrical rollers or mounting tables, and more particularly, is directed to a method and apparatus for laser ablating an image on mounted blank printing plates.

It is known to provide an image on a printing plate, and thereafter, mount the printing plate on a roller for a printing operation. It is also known to mount a blank printing plate on a roller or mounting table for use in a printing apparatus, and thereafter, laser ablate the printing plate to produce an image on the mounted printing plate. The present invention is directed to the latter arrangement in which a blank printing plate is mounted, and then, the image is formed thereon.

It is well-known to use mounted blank printing plates in a printing operation. The printing rollers can include one or more sleeves and/or other layers thereon. The printing plates, after being mounted on the rollers, are etched or engraved in accordance with a desired image in order to effect the printing operation. It is also known to provide such etching or engraving of the image on the printing plate by means of a laser. An example of a system for performing this operation is disclosed, for example, in U.S. Pat. No. 7,284,484, which discloses the laser ablating of a blank printing plate mounted on a printing roller.

When laser ablating an image onto the printing plate, all areas which are not image transfer areas, including edges of the printing plate, are always laser ablated to form recesses or reliefs at which no printing occurs. Thus, the areas of the printing plate outside of the image area are laser ablated to provide recesses or reliefs, which do not affect printing.

However, a problem with this operation is that the laser will oftentimes extend past an edge of the printing plate during the laser ablating operation, and inadvertently and undesirably laser ablate a portion of the roller, the sleeve mounted on the roller or the mounting table, on which the printing plate is mounted. This, however, can damage the roller, the sleeve or the mounting table.

There are several ways to avoid damage to the roller, sleeve or mounting table, including but not limited to, masking the edges of the printing plate with a reflective foil, which reflects the laser and protects the roller, sleeve or mounting table from damage. It is also possible to provide a printing plate which has significantly larger size than the area of print needed, to ensure that the laser starts and stops within the boundaries of the printing plate. However all of these methods can require additional equipment, materials, time and expense, to make them work.

SUMMARY OF THE INVENTION

Accordingly, it is an object of the present invention to provide a method and apparatus for laser ablating an image on a blank printing plate mounted on a roller, that overcomes the aforementioned problems.

It is another object of the present invention to provide a method and apparatus for laser ablating an image on a blank printing plate mounted on a roller that precisely ablates a printing plate mounted on a roller or sleeve.

It is still another object of the present invention to provide a method and apparatus for laser ablating an image on a blank printing plate mounted on a roller or sleeve and ablating precisely to the edges of the printing plate, but avoiding ablation past the boundaries of the printing plate.

It is yet another object of the present invention to provide a method and apparatus for laser ablating an image on a blank printing plate mounted on a roller that is easy and economical to use.

In accordance with an aspect of the present invention, a method for laser ablating an image on a mounted blank printing plate, includes the steps of detecting positions of at least one edge of the mounted blank printing plate, and determining positions of all edges of the blank printing plate in accordance with the step of detecting. An image area is determined within boundaries of the blank printing plate, and reliefs are laser ablated on the blank printing plate to create an image. The laser is controlled to prevent any laser ablation outside of boundaries of the edges of the printing plate, based on the step of determining positions of all edges of the printing plate.

The step of detecting positions of at least one edge of the printing plate, uses either electromagnetic radiation or a mechanical device to detect the positions.

In one embodiment, the step of detecting positions of at least one edge of the printing plate, includes the step of detecting the positions of all edges of the printing plate, and the step of determining positions of all edges of the printing plate in accordance with the step of detecting, includes the step of determining the positions of each edge of the printing plate in accordance with the detected position of each respective edge.

In another embodiment, the step of detecting positions of at least one edge of the printing plate, includes the step of detecting the position of less than all edges of the printing plate, and the step of determining positions of all edges of the printing plate in accordance with the step of detecting, includes the steps of determining the positions of each detected edge of the printing plate in accordance with the detected position of each respective edge, and calculating the positions of the remaining non-detected edges from the dimensions and shape of the printing plate and the position of at least one detected edge.

The step of determining an image area within boundaries of the printing plate, includes the step of calculating the size, shape and position of the image area such that the image area falls within the boundaries of the printing plate.

The step of controlling the laser to prevent any laser ablation outside of boundaries of the edges of the printing plate, based on the step of determining positions of all edges of the printing plate, includes the step of controlling imaging of the laser to an area within edges of the printing plate, and/or controlling power of the laser to avoid imaging outside edges of the printing plate.

In accordance with another aspect of the present invention, a method for laser ablating an image on a mounted blank printing plate having an image area, at least one edge and a peripheral tolerance region of a thickness less than the image area at at least one edge of the printing plate, includes the steps of detecting positions of at least one edge of the mounted blank printing plate, and determining positions of all edges of the blank printing plate in accordance with the step of detecting. An image area is determined within boundaries of the blank printing plate, and reliefs are laser ablated on the blank printing plate to create an image. The laser is controlled to stop any laser ablation within boundaries of the peripheral tolerance region.

The peripheral tolerance region includes one of the following: a beveled area, a stepped area, or a curved area.

In accordance with still another aspect of the present invention, apparatus for laser ablating an image on a mounted blank printing plate, includes a detector which detects positions of at least one edge of the mounted blank printing plate, a control device which determines positions of all edges of the blank printing plate in accordance with the step of detecting and which determines an image area within boundaries of the blank printing plate, a laser which laser ablates reliefs on the blank printing plate to create an image, and the control device controls the laser to prevent any laser ablation outside of boundaries of the edges of the printing plate, based on the determined positions of all edges of the printing plate.

The detector uses electromagnetic radiation or a mechanical device to detect the positions.

In one embodiment, the detector detectors the positions of all edges of the printing plate, and the control device determines the positions of each edge of the printing plate in accordance with the detected position of each respective edge.

In another embodiment, the detector detects the positions of less than all edges of the printing plate, and the control device determines the positions of all edges of the printing plate by determining the positions of each detected edge of the printing plate in accordance with the detected position of each respective edge, and calculating the positions of the remaining non-detected edges from the dimensions and shape of the printing plate and the position of at least one detected edge.

The control device determines the image area within boundaries of the printing plate, by calculating the size, shape and position of the image area such that the image area falls within the boundaries of the printing plate.

The control device controls the laser to prevent any laser ablation outside of boundaries of the edges of the printing plate, based on the determination of the positions of all edges of the printing plate, by at least one of controlling imaging of the laser to an area within edges of the printing plate, and controlling power of the laser to avoid imaging outside edges of the printing plate.

In accordance with yet another aspect of the present invention, apparatus for laser ablating an image on a mounted blank printing plate having an image area, at least one edge and a peripheral tolerance region of a thickness less than the image area at at least one edge of the printing plate, includes a detector which detects positions of at least one edge of the mounted blank printing plate, a control device which determines positions of all edges of the blank printing plate in accordance with the step of detecting and which determines an image area within boundaries of the blank printing plate, a laser which laser ablates reliefs on the blank printing plate to create an image, and the control device controls the laser to stop any laser ablation within boundaries of the peripheral tolerance region.

The peripheral tolerance region includes one of the following: a beveled area, a stepped area, or a curved area.

The above and other objects, features and advantages of the invention will become readily apparent from the following detailed description thereof which is to be read in connection with the accompanying drawings.

DETAILED DESCRIPTION

Figure 1:
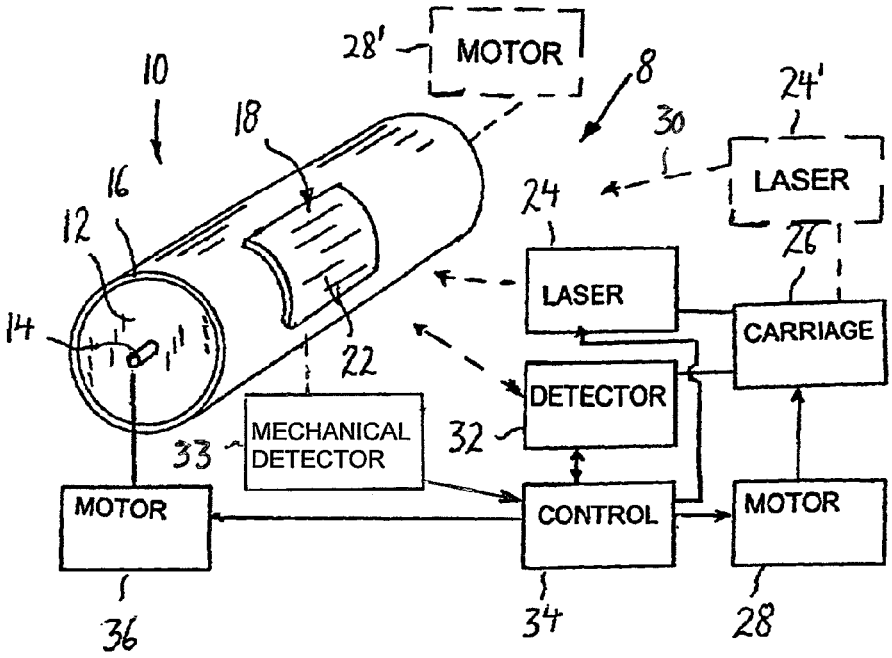
FIG. 1 is perspective view and block diagram of apparatus according to one embodiment of the present invention.
Figure 2:
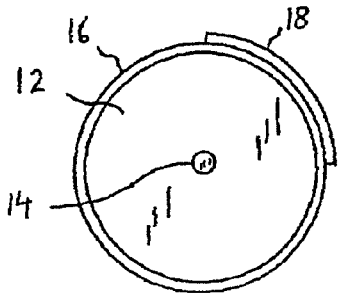
FIG. 2 is an end elevational view of the printing roller and printing plate of FIG. 1.

Referring to the drawings in detail, and initially to FIGS. 1 and 2 thereof, a printing roller 10 for a printing press, such as a flexographic printing press, includes a cylindrical roller 12 mounted on a shaft 14. In this instance, printing roller 12 further includes an annular sleeve 16 mounted on cylindrical roller 12, although annular sleeve 16 can be eliminated. Preferably, sleeve 16 extends completely around the entire circumference of cylindrical roller 12. A blank printing plate 18 is mounted on an outer surface of sleeve 16. Printing plate 18 will be engraved in order to produce an image during a printing operation, as is well known in the art.

Because printing plate 18 according to the present invention will be laser ablated, they are preferably made of materials that permit such laser ablating, including but not limited to any flexible substrate made from a photopolymer, vulcanized rubber, a thermal polymer, or any other suitable material, and including but not limited to the materials discussed in U.S. Pat. Nos. 5,804,353; 6,551,759; 6,551,762; 6,159,659; 6,627,385; 6,776,095; 6,794,115; 6,737,216; 6,178,852; and 6,797,455, the entire disclosures of which are incorporated herein by reference.

An apparatus 8 for laser ablating printing plate 18 to form an image 22 thereon includes a laser 24, such as a $CO_2$ laser, a YAG laser or any other suitable laser, to ablate the outer surface of printing plate 18. Laser 24 is preferably mounted on a movable carriage 26 that can move along the lengthwise direction of printing plate 18 by means of a drive motor 28. Alternatively, as shown by dashed lines in FIG. 1, a drive motor 28' can be used to move printing roller 10 in the lengthwise direction thereof relative to laser 24 which is stationary. Still further, although not conventional, both drive motor 28 and drive motor 28' can be used in conjunction with each other. In other words, it is only important that there be relative lengthwise movement of laser 24 and printing roller 10 relative to each other. Alternatively, while not currently available, both printing roller 10 and laser 24 can be stationary, and laser 24 can be controlled to ablate in the lengthwise direction of printing roller 10. If printing roller 10 is too long for such an operation, a plurality of lasers 24 can be mounted in spaced relation along the lengthwise direction of printing roller 10 for such ablating operation.

In order to control laser 24 to correctly ablate printing plate 18, it is necessary to first measure the position of printing plate 18.

In this regard, laser 24', which is preferably also mounted on carriage 26 and driven by motor 28 to move along the surface of roller 12 as roller 12 is rotated by motor 36, focuses a beam of light 30 that is bounced off the outer surface of printing plate 18, sleeve 16 and/or roller 10, and received by a detector 32, such as an optical detector, while laser 24' is moved with carriage 26. As an alternative, it is feasible to have scanning laser 24' supported on a different carriage on the same machine, or even on two different machines. However, in the latter case, a point of reference would have to be established between the two systems.

Alternatively, detector 32 can provide its own source of light against sleeve 16, which is then bounced off the outer surface of printing plate 18, sleeve 16 and/or roller 10 and received by detector 32. For example, detector 32 can include a conventional photodiode which directs light against sleeve 16, and a photodetector which detects the light reflected back therefrom. Generally, any signal waves in the electromagnetic spectrum can be used for such detection operation, which include, without limitation visible light rays, infrared rays, laser light, etc.

A signal corresponding to this detection operation is then provided by detector 32 to a control device 34 which can be a computer programmed to control the ablation and relative movement of laser 24 and printing roller 10. Control device 34 controls drive motor 28 and/or drive motor 28' to control relative lengthwise movement of printing roller 10 and laser 24' during the measurement operation, and also controls a separate drive motor 36 to rotate cylindrical roller 12 by small increments. In this manner, the entire surface area where printing plate 18 is mounted, sleeve 16 and/or roller 10, is scanned. Alternatively, as discussed above, laser 24' can be stationary and carriage 26, drive motor 28 and drive motor 28' can be eliminated, and in such case, control device 34 would control stationary laser 24' to scan across printing roller 10 in the lengthwise direction thereof.

From these measurements, the portions of the outer surface of printing plate 18 that need to be ablated in order to create the image area thereon, are determined by control device 34. Laser 24 then ablates those portions of the outer surface of printing plate 18 in accordance therewith. Thus, there is preferably relative longitudinal movement between roller 10 and laser 24, as well as rotation of roller 10 caused by drive motor 36.

In a modification thereof, second scanning laser 24' can be eliminated and laser 24 can be used for both the measurement and the ablation operation.

As discussed above, when laser ablating an image onto printing plate 18, the edges of printing plate 18 are always laser ablated to form recesses or reliefs 40 at which no printing occurs. Thus, the areas of printing plate 18 outside of the image area are laser ablated to provide recesses or reliefs 40, which do not print.

However, a problem with this operation is that the laser will oftentimes extend past an edge of printing plate 18 during the laser ablating operation, and inadvertently and undesirably laser ablate a portion of roller 10 or sleeve 16 mounted on roller 10, on which printing plate 18 is mounted. This, however, can damage roller 10 or sleeve 16 thereon. This is because there is a sharp edge at the periphery of printing plate 18, that is, an edge which is perpendicular to the upper surface thereof.

Figure 3:
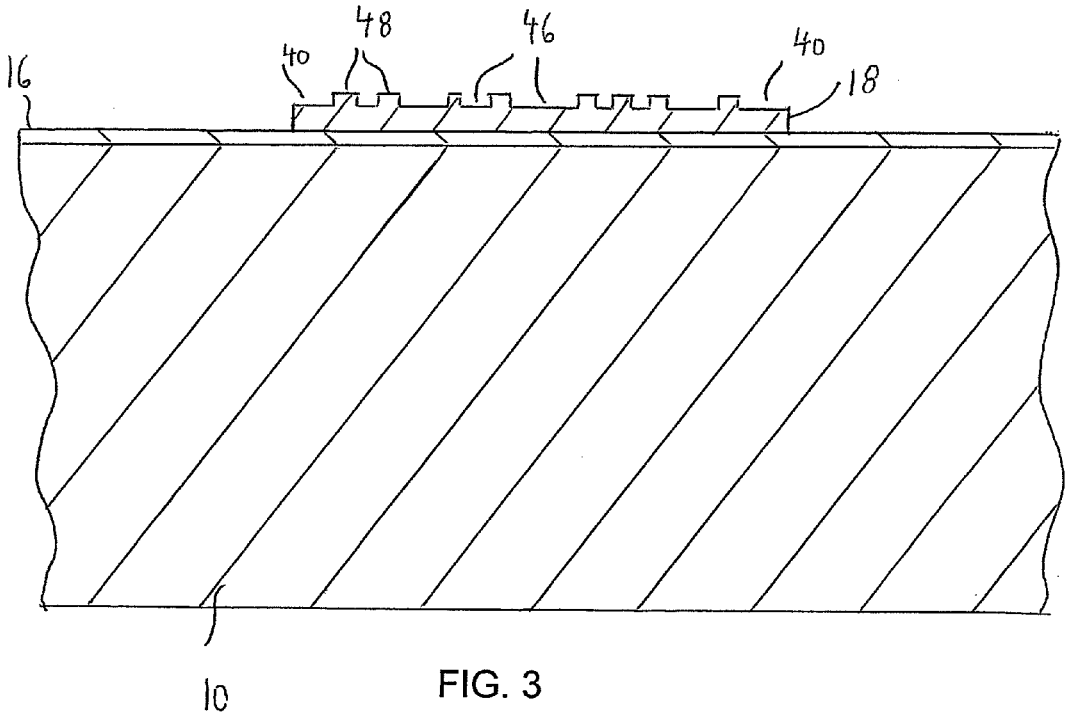
FIG. 3 is a cross-sectional view of a portion of the printing roller and printing plate of FIG. 2.
Figure 4:
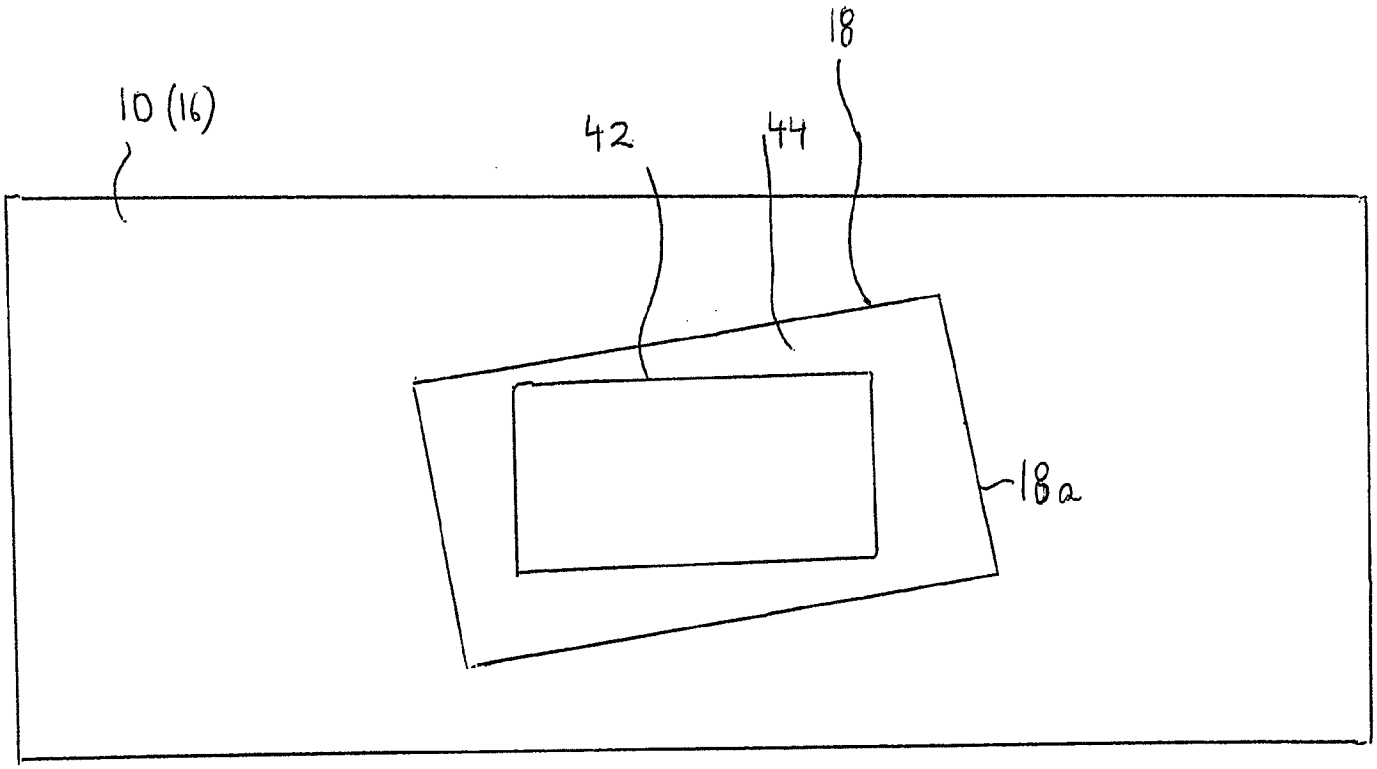
FIG. 4 is a plan view of a portion of the printing roller and printing plate of FIG. 2.
Figure 5:
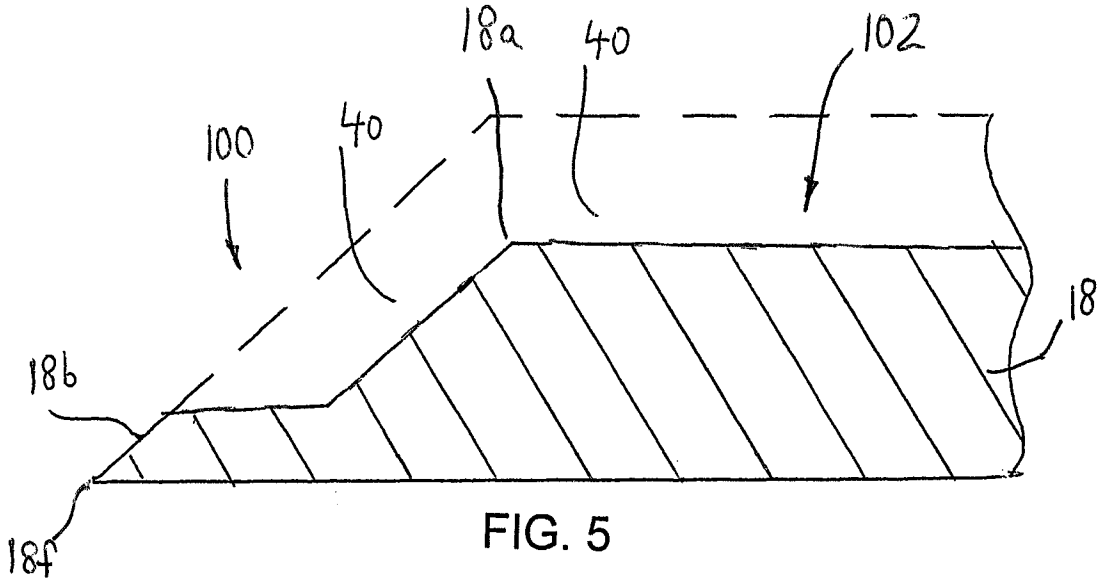
FIG. 5 is a cross-sectional view of a portion of a beveled edge of a printing plate mounted on a printing roller of FIG. 2 according to a modification.

With reference to FIGS. 3-5, printing plate 18 is shown mounted askew on roller 10, and an image area 42 has been formed on printing plate 18 by laser ablation. An image has been formed on the upper surface of printing plate 18 by laser ablating areas of printing plate 18 to form recesses or reliefs 46, with raised surfaces 48 between the recesses 46. The laser ablation can occur with laser 24. The image is used to print on a web or the like passing through the printing machine, by transfer of ink from the upper raised surfaces 48. It is also noted that the edges of printing plate 18 are always laser ablated to form recesses or reliefs 40 at which no printing occurs.

Generally, while roller 10 is rotated, the laser apparatus positioned thereabove laser ablates printing plate 18 to form recesses or reliefs 40 and 46, and thereby form the image to be printed by raised surfaces 48. The areas 44 of printing plate 18 outside of image area 42 which are laser ablated to provide recesses or reliefs 40, do not print.

However, a problem with this operation is that the laser will oftentimes extend past an edge, for example, edge 18*a* of printing plate 18 during the laser ablating operation, and inadvertently and undesirably laser ablate a portion of roller 10, or sleeve 16 mounted on roller 10 beneath printing plate 18, which could damage roller 10 or sleeve 16 thereon.

Therefore, in accordance with the present invention, printing plate 18 is first mounted on a cylindrical roller 10 in a general area where the image is to be formed, with printing plate 18 being larger than image area 42. It is verified that plate 12 is in the correct position to receive the entire image area 42 therewithin, that is, image area 42 does not extend outside of the area of plate 18.

Thereafter, at least one edge 18*a* of printing plate 18 is detected, and preferably all four edges 18*a* of printing plate 18 are detected. The detection of the edges 18*a* occurs by a scanning laser, for example, laser 24', which passes over cylindrical roller 10, scanning and identifying the position of the edges of each printing plate 18 thereon. A digital template of the plate position is created by the scan, thereby setting the outer limits that the laser will engrave to coincide with edges 18*a* of printing plate 18. Alternatively, a mechanical detector 33, such as a mechanical finger connected to a detector, can be used to detect the edges.

The image area 42 is then ablated by laser 24 within the bounds of printing plate 18. During this process, areas 44 outside of image area 42 are ablated to provide recessed areas or reliefs 40 at which no printing occurs.

By detecting edges 18*a* of printing plate 18, this ensures that the laser ablating operation, when forming reliefs 40, will not extend to roller 10 and/or carrier sleeve 16, so that roller 10 and/or carrier sleeve 16 thereon will not be damaged.

It will be appreciated that, if the dimensions and shape of printing plate 18 are known, then it may only be necessary to detect one edge 18*a*. In such case, the positions of the remaining edges 18*a* can be calculated from the dimensions and shape of printing plate 18 and the position of the one detected edge 18*a*.

According to an important aspect of the present invention, a peripheral tolerance region 100 is provided just to the outside of edges 18*a* of printing plate 18, in surrounding relation to a central area 102 with the image formed thereon. As shown in FIG. 5, one example of a peripheral tolerance region 100 is a beveled edge 18*b*, as shown by the enlarged edge 18*a* of attached FIG. 5. In such case, recessed areas or reliefs 40 of central area 102 are ablated. However, the beveled edge 18*b* provides a tolerance or leeway to account for any variations in position of printing plate 18 and/or laser 24 that may occur during the ablating operation. The beveled edge 18*b* not only defines a specific edge for the boundary of printing plate 18, but also provides a transition region for the laser 24 to switch on and off with a practical tolerance level. This is important because of the difficulty to ensure that the surface of the printing plate 18 is absolutely flat on all edges of printing plate 18, which could in turn influence the detection of an edge of printing plate 18, and hence, the point at which laser imaging starts and stops.

Preferably, beveled edge 18*b* has an inclination in the range of 5 degrees to 85 degrees; more preferably in the range of 30 degrees to 60 degrees; and still more preferably, at 45 degrees.

Figure 5A:
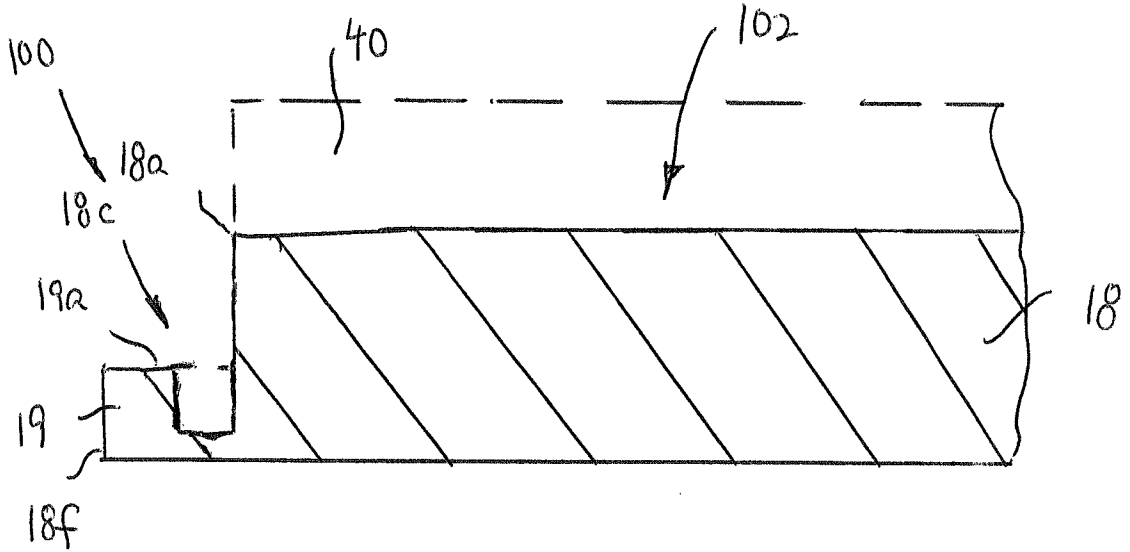
FIG. 5A is a cross-sectional view of a portion of a stepped edge of a printing plate mounted on a printing roller of FIG. 2 according to a modification.

It will be appreciated, however, that other peripheral tolerance regions 100 can be provided. For example, as shown in FIG. 5A, peripheral tolerance region 100 can be a stepped region 18*c* with one or more steps 19. The thickness of step 19 in FIG. 5A needs to be slightly greater than the maximum relief of the image area to ensure that the laser does not burn through step 19 into the sleeve or cylinder, and also, the upper surface 19*a* of step 19 has to be at least as low as recessed areas or reliefs 40 so that it does not form part of the printed image.

Figure 5B:
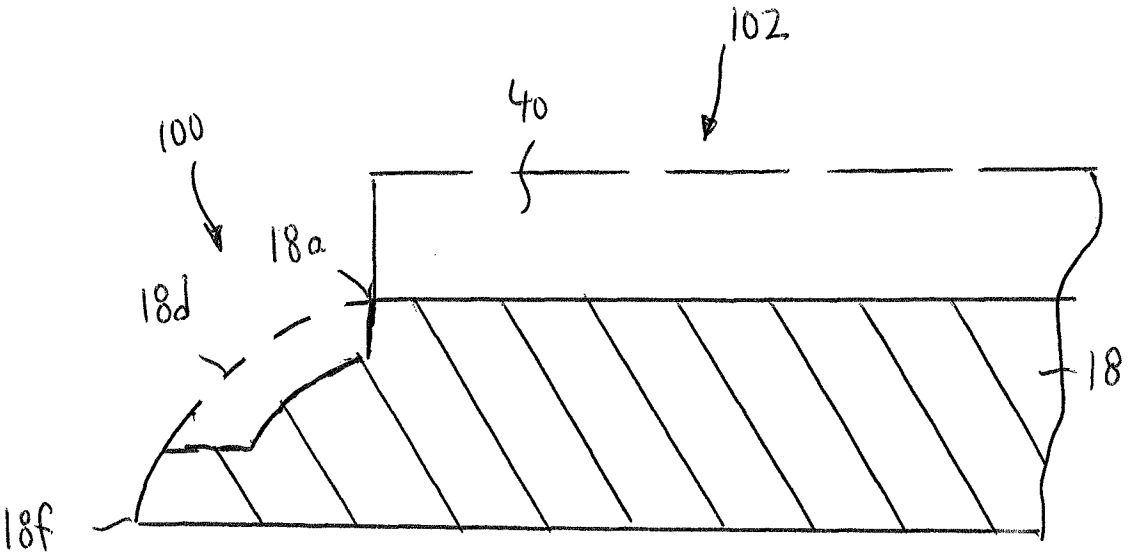
FIG. 5B is a cross-sectional view of a portion of a convex edge of a printing plate mounted on a printing roller of FIG. 2 according to a modification.
Figure 5C:
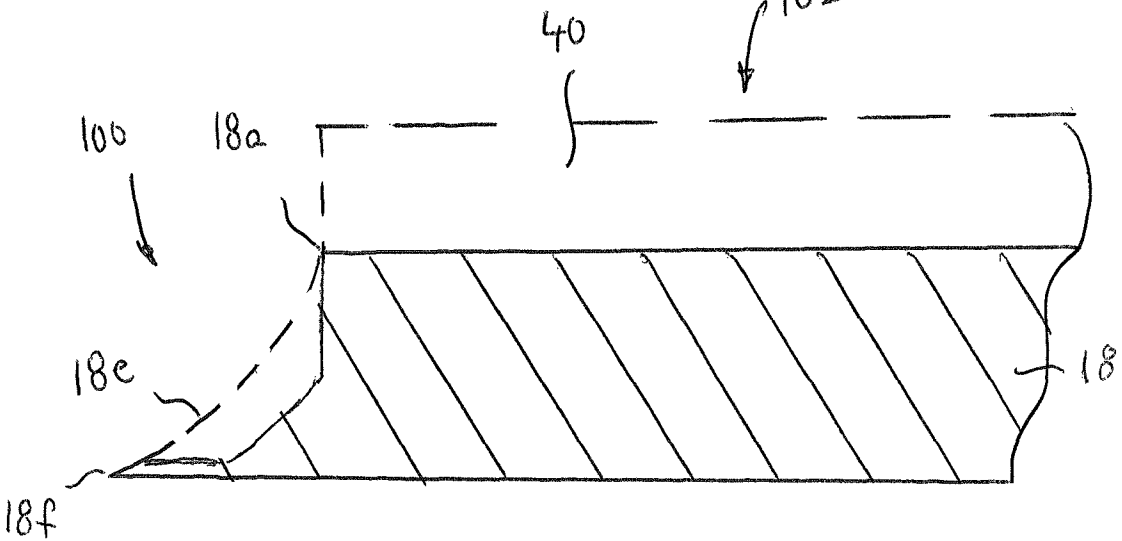
FIG. 5C is a cross-sectional view of a portion of a concave edge of a printing plate mounted on a printing roller of FIG. 2 according to a modification.

As further examples, peripheral tolerance region 100 can be a convex curved region 18*d* as shown in FIG. 5B; or a concave curved region 18*e* as shown in FIG. 5C. The present invention, however, is not limited to these peripheral tolerance regions 100.

The key is that peripheral tolerance region 100 allows for tolerances in the mechanics and in detection.

Figure 6:
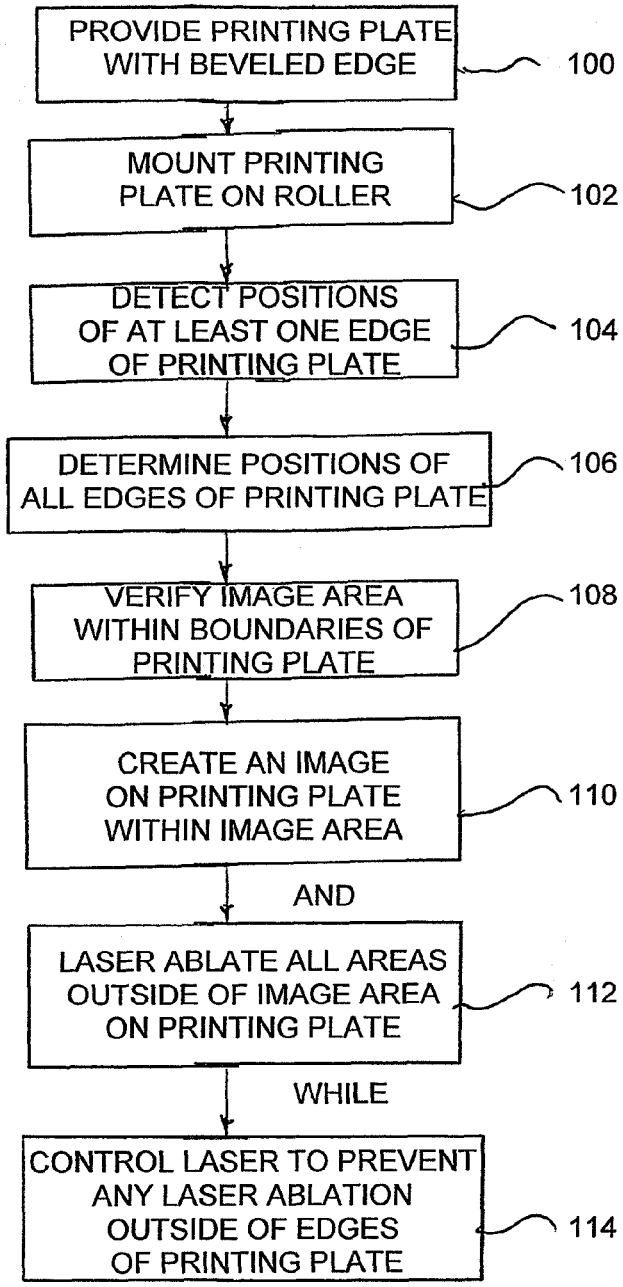
FIG. 6 is a flow chart diagram describing the method according to the present invention.

In accordance with the above, and referring to FIG. 6, a preferred method for laser ablating an image on printing plate 18 mounted on roller 10 includes a first step 100 of providing a printing plate with a peripheral tolerance region 100 such as beveled edge 18*b* and then, in step 102, mounting printing plate 18 on roller 10. However, it will be appreciated that step 100 can be eliminated and a conventional printing plate 18 can be provided. Thereafter, in step 104, the position of at least one edge 18*a* of printing plate 18 mounted on roller 10 is detected. Alternatively, the edge 18*f* of beveled area 18*b* can be detected if the width of beveled area 18*b* is known. The positions of all edges 18*a* of printing plate 18 are then determined in step 106 in accordance with the step of detecting. This can occur by processing the detected information of all edges 18*a*, or by processing the detection information of one edge 18*a* and then calculating the positions of the other edges 18*a* in view of the detected edge 18*a* and the dimensions and shape of printing plate 18.

Thereafter, image area 42 within boundaries of printing plate 18 is verified in step 108. This is accomplished by calculating the size, shape and position of an image area 42 such that the image area 42 falls within the boundaries of printing plate 18, for example, by control device 34. An image on printing plate 18 which is used for printing an image on a medium, within image area 42 is then ablated with laser 24 in step 110. Before, thereafter or simultaneously with the laser ablation of image area 42, in step 112, all areas 40 outside of image area 42 on printing plate 18 are laser ablated with laser 24 to provide a relief area 40 at which no printing on the medium will occur, based on the step of determining positions of all edges 18*a* of printing plate 18.

Lastly, in step 114, laser 24 is controlled by control device 34 to prevent any laser ablation outside of boundaries of edges 18*a* of printing plate 18, based on the step of determining positions of all edges 18*a* of printing plate 18. This can occur, for example, by repositioning the laser to an area within edges 18*a* of printing plate 18 and/or reducing or stopping power of the laser outside edges 18*a* of printing plate 18. This last step will occur simultaneously with the laser ablation of relief area 40.

Having described specific preferred embodiments of the invention with reference to the accompanying drawings, it will be appreciated that the present invention is not limited to those precise embodiments and that various changes and modifications can be effected therein by one of ordinary skill in the art without departing from the scope or spirit of the invention as defined by the appended claims.

What is claimed is:

1. A method for laser ablating to form an image on a mounted blank printing plate having an image area, at least one edge and a peripheral tolerance region of a thickness less than the image area at the at least one edge of the printing plate, comprising the steps of:

detecting positions of at least one edge of the mounted blank printing plate, determining positions of all edges of the mounted blank printing plate in accordance with the step of detecting, determining an image area within the edges of the mounted blank printing plate, laser ablating reliefs on the mounted blank printing plate to create an image, and controlling the laser to stop any laser ablation within the peripheral tolerance region, wherein the peripheral tolerance region is in the form of one of the following:

a beveled area, a stepped area, and a curved area, and wherein the laser transitions on and off in the peripheral tolerance region in order to accommodate a practical tolerance for the switching on and off of the laser in the peripheral tolerance region.

2. A method according to claim 1, wherein said step of controlling the laser to stop any laser ablation, includes the step of at least one of:

a) controlling imaging of the laser to an area within the edges of the printing plate, and b) controlling power of the laser to avoid imaging outside the edges of the printing plate.

3. A method according to claim 1, wherein said step of detecting positions of at least one edge of the printing plate, uses electromagnetic radiation to detect said positions.

4. A method according to claim 1, wherein said step of detecting positions of at least one edge of the printing plate, uses a mechanical device to detect said positions.

5. A method according to claim 1, wherein said step of detecting positions of at least one edge of the printing plate, includes the step of detecting the positions of all edges of the printing plate, and said step of determining positions of all edges of the printing plate in accordance with the step of detecting, includes the step of determining the positions of each edge of the printing plate in accordance with the detected position of each respective edge.

6. A method according to claim 1, wherein said step of detecting positions of at least one edge of the printing plate, includes the step of detecting the position of less than all edges of the printing plate, and said step of determining positions of all edges of the printing plate in accordance with the step of detecting, includes the steps of:

determining the positions of each detected edge of the printing plate in accordance with the detected position of each respective edge, and calculating the positions of the remaining non-detected edges from the dimensions and shape of the printing plate and the position of at least one detected edge.

7. A method according to claim 1, wherein said step of determining the image area within the edges of the printing plate, includes the step of calculating the size, shape and position of the image area such that the image area falls within the edges of the printing plate.

8. Apparatus for laser ablating to form an image on a mounted blank printing plate having an image area, at least one edge and a peripheral tolerance region of a thickness less than the image area at the at least one edge of the printing plate, comprising:

a detector which detects positions of at least one edge of the mounted blank printing plate, a control device which determines positions of all edges of the mounted blank printing plate in accordance with the detection by the detector and which determines an image area within the edges of the blank printing plate, a laser which laser ablates reliefs on the mounted blank printing plate to create an image, and the control device controls the laser to stop any laser ablation within the peripheral tolerance region, wherein the peripheral tolerance region is in the form of one of the following:

a beveled area, a stepped area, and a curved area, and wherein the control device controls the laser to transition on and off in the peripheral tolerance region in order to accommodate a practical tolerance for the switching on and off of the laser in the peripheral tolerance region.

9. Apparatus according to claim 8, wherein said control device controls the laser to prevent any laser ablation outside of the edges of the printing plate, based on the determination of the positions of all edges of the printing plate, by at least one of:

a) controlling imaging of the laser to an area within the edges of the printing plate, and b) controlling power of the laser to avoid imaging outside the edges of the printing plate.

10. Apparatus according to claim 8, wherein said detector uses electromagnetic radiation to detect said positions.

11. Apparatus according to claim 8, wherein said detector uses a mechanical device to detect said positions.

12. Apparatus according to claim 8, wherein said detector detects the positions of all edges of the printing plate, and said control device determines the positions of each edge of the printing plate in accordance with the detected position of each respective edge.

13. Apparatus according to claim 8, wherein said detector detects the positions of less than all edges of the printing plate, and said control device determines the positions of all edges of the printing plate by:

determining the positions of each detected edge of the printing plate in accordance with the detected position of each respective edge, and calculating the positions of the remaining non-detected edges from the dimensions and shape of the printing plate and the position of at least one detected edge.

14. Apparatus according to claim 8, wherein said control device determines the image area within the edges of the printing plate, by calculating the size, shape and position of the image area such that the image area falls within the edges of the printing plate.

* * * * *